United States Patent [19]

Bordiga

[11] 4,015,556

[45] Apr. 5, 1977

[54] DEVICE FOR PROPELLING BOATS

[76] Inventor: Alejandro Lorenzo Carlos Bordiga, Avenida San Martin 4180, Buenos Aires, Argentina

[22] Filed: Mar. 26, 1976

[21] Appl. No.: 670,971

Related U.S. Application Data

[63] Continuation of Ser. No. 476,034, June 3, 1974, abandoned.

[30] Foreign Application Priority Data

June 4, 1973 Argentina ..... 248381
Feb. 6, 1974 Argentina ..... 252209

[52] U.S. Cl. ..... 115/39; 115/12 R; 115/16

[51] Int. Cl.[2] ..... B63H 5/16

[58] Field of Search ..... 115/39, 12 R, 14, 16; 114/150, 151

[56] References Cited

UNITED STATES PATENTS 2,764,117 9/1956 De Persia ..... 115/39 X
3,465,705 9/1969 Castoldi ..... 115/12 R
3,515,087 6/1970 Stuart ..... 115/39 X

FOREIGN PATENTS OR APPLICATIONS 89,075 3/1895 Germany ..... 115/16

*Primary Examiner*—Trygve M. Blix
*Assistant Examiner*—Sherman D. Basinge

[57] ABSTRACT

A propelling device for a propeller-driven boat comprising a longitudinally extending tunnel disposed at the aft portion of the boat housing a propeller for rotation at a level above the keel of the boat. A pair of deflector fins are pivotally carried for rotation about parallel vertical axes located on opposite sides of the longitudinal axis of the tunnel at a position rearwardly of the propeller. A curved deflector plate is pivotably supported for movement about a horizontal axis rearwardly of the fins for movement between a raised inoperative position and a lowered operative position.

5 Claims, 13 Drawing Figures

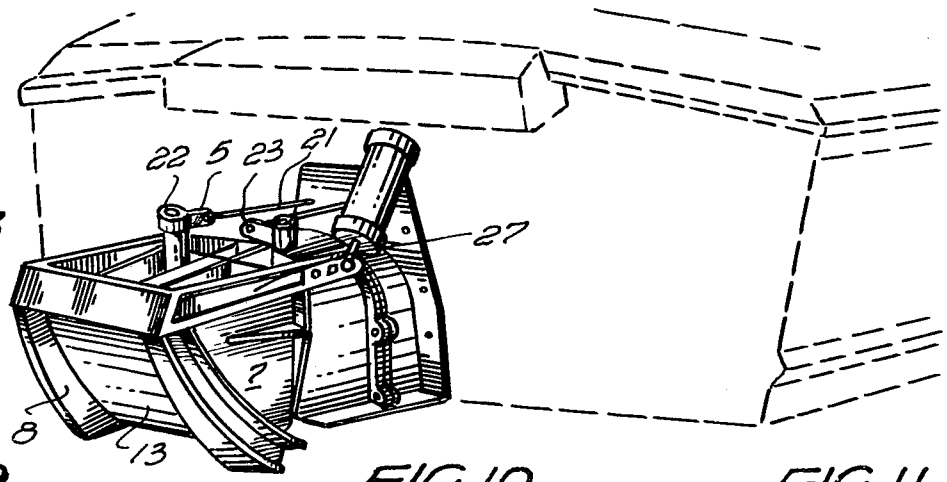
FIG. 13
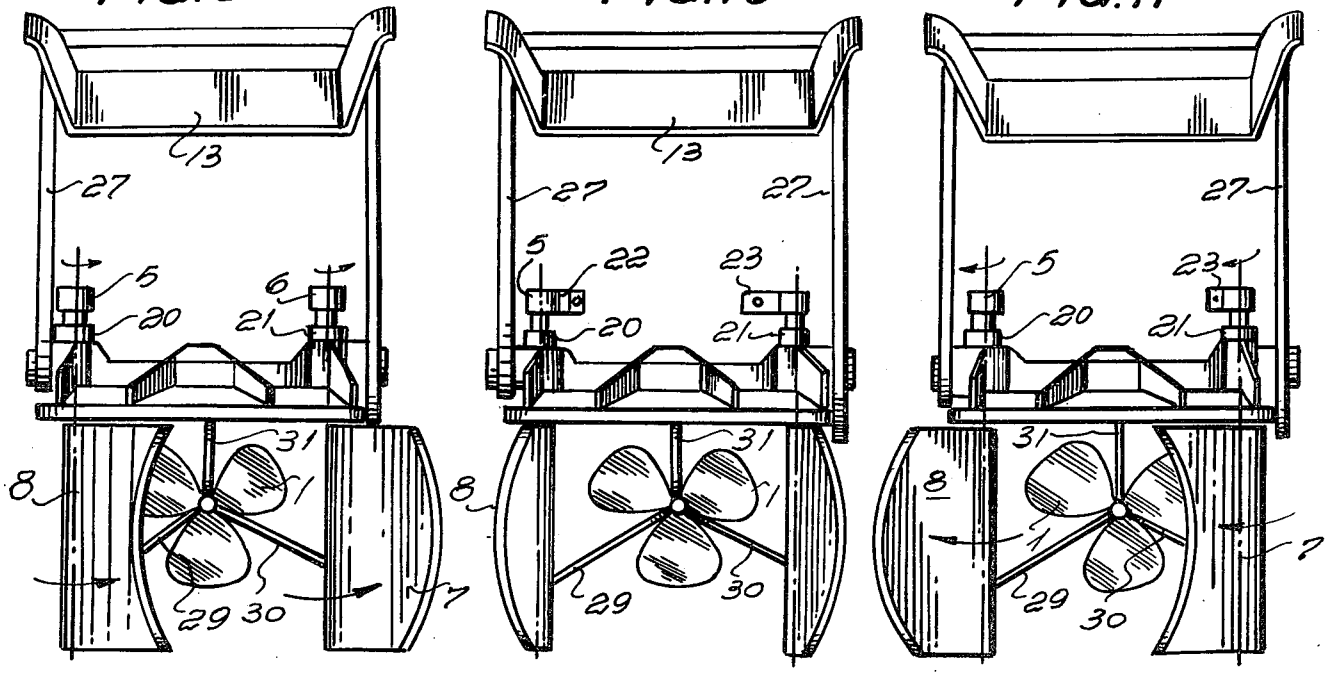
FIG. 11
FIG. 10
FIG. 9

DEVICE FOR PROPELLING BOATS

CROSS RELATED APPLICATION

This application is a continuation of application Ser. No. 476,034 filed June 3, 1974 (now abandoned).

This invention relates to a new device for propelling boats and is directed principally towards increasing the output of the propellers and the reliability of the propelling system.

The devices used at present for propelling boats, either for sport or commercially, may be of the propeller type or the jet type.

In the case of boats of the propeller type several variants are used, such as attaching the engine inside the boat with the propeller fixed beneath the hull; attaching the engine outside the boat, or both inside and outside the boat, with the propeller mounted on a movable leg.

The jet type boats may use an inside pump with an outside, generally movable, jet; or a movable pump attached outside the boat.

Over the years the propeller system has been modified many times, increasing the mechanical complexity as well as the capital investment and the operating and maintenance costs.

It is thus necessary to develop mechanical devices that are simpler, perform better and cost less. The art arrived thus at the hydrojet system which meets the first two requirements but is somewhat costly.

The propelling device according to the present invention is mechanically simple, of high performance and low cost and has additionally a number of very important advantages.

The propelling device of this invention uses a propeller of conventional or special type that rotates in the end of a tunnel-shaped cavity, open below, provided in the hull; the rotation of the propeller being such that the circumference described by the end points of the propeller blades lies in a plane normal to the axis of the passage and over the keel line of the boat.

The propeller thus operates partially encased, moving the water coaxially with respect to the axis of rotation of the propeller. The thus activated mass of water passes between two biasable fins rotatably mounted on vertical shafts and capable of deflecting horizontally the mass of water, thus controlling the bearing.

The reverse motion is obtained by means of a curved plate interposed in the exit section of the mass of water and deflecting the same downwards and forwards, thus producing by reaction the breaking or reverse motion of the boat, the direction being controlled by the combined actions of the biasable fins and the curved plate.

In a variant, the tunnel-shaped cavity extends from the stern transom to the outside of the lull by means of a tubular casing the upper part of which extends beyond a rear end section, forming housings for the shafts of two parallel fins arranged at each side of the propeller, adjacent to the said end section, and for a third shaft which is perpendicular to the said two shafts and supports the curved plate; in addition, three partitions are provided inside the tunnel..

The propeller thus operates with a marked improvement in performance, and the propelling system combines the simplicity and high yield of the jet systems with the relatively low cost of the conventional systems.

In fact, by producing the reverse motion of the boat by reversal of the direction of movement of the mass of water, it is not necessary to reverse the rotation of the propeller in the driving device, which simplifies the structure of the latter as the gears may be replaced by belts with the consequent lowering of costs.

On the other hand, the fact that the propeller, the biasable fins and the curved plate controlling the reverse motion are above the keel line makes it possible to drag the hull along a beach, up a ramp, or onto a conventional truck, without damaging the said parts. Furthermore, the boat may be sailed in low water or where there are obstacles without endangering the propeller or the steering device.

The arrangement of the variant allows the device of this invention to be adapted to normal vessels, improving the performance of the prime mover without any major modifications and obtaining the reverse motion of the boat without reversing the running of its engine.

In order to explain clearly this invention and the best made for carrying it out, a preferred embodiment of the same will now be described with reference to the annexed drawings in which:

FIGS. 9 to 11 are views of the boat, such as the one shown in FIG. 8, seen from the stern and in various positions of the biasable fins;

FIG. 13 is a perspective view of a boat equipped with the device according to the variant shown in FIG. 8.

Figure 1:
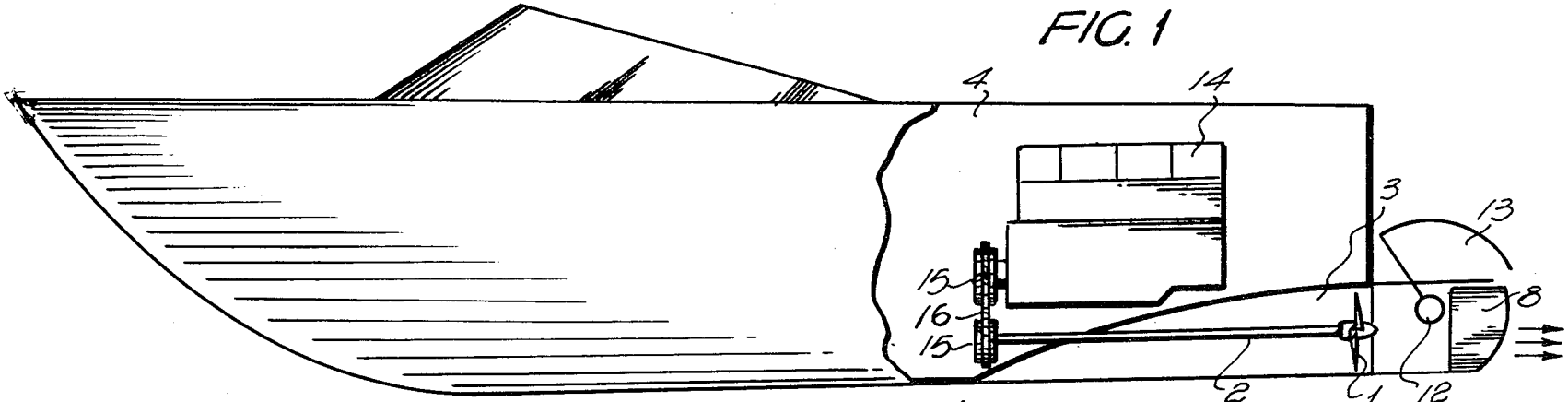
FIG. 1 is a side elevation vein of a boat embodying the propelling systems according to the present invention, using a belt control.

In these drawings, the same reference numbers identify identical or corresponding parts of the device according to this invention, which comprises a propeller 1 mounted on a shaft 2 and housed in a tunnel 3 at the aft section of the hull of boat 4, the tunnel being open below, the height of which tunnel increases towards the stern of the boat 4 so that the circumference 4' described by the end points of the propeller blades lies in a plane normal to the axis of passage , which of the tunnel is situated above the keel line of the boat 4. The propeller 1 operates partially encased in the tunnel 3, practically as if it were a jet system pushing the water towards the stern coaxially with respect to the shaft 2.

Biasable fins 7 and 8 are mounted relatively on shafts 5 and 6 and are arranged parallel to each other so that the mass of water impelled by the propeller 1 passes between them; thus, by changing the position of the said fins the direction taken by the mass of water may be changed and consequently the direction of movement of the boat may be controlled (FIGS. 4, 5, 9, 10 and 11). In order to keep the fins 7 and 8 parallel to each other control rods 9 and 10, fixed to the upper ends of the fins, are attached to a connecting rod 11 to which a steering system is operatively connected.

Figure 6:
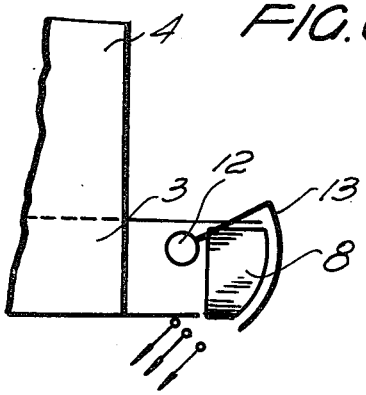
FIG. 6 shows schematically the curved plate in breaking or reverse motion position.
Figure 4:
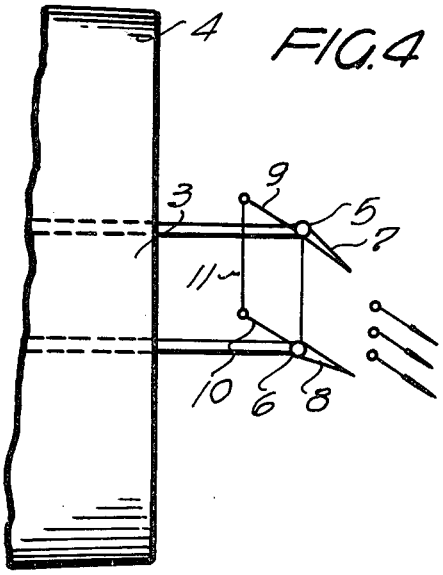
FIG. 4 shows schematically the biasable fins turned towards the left.
Figure 5:
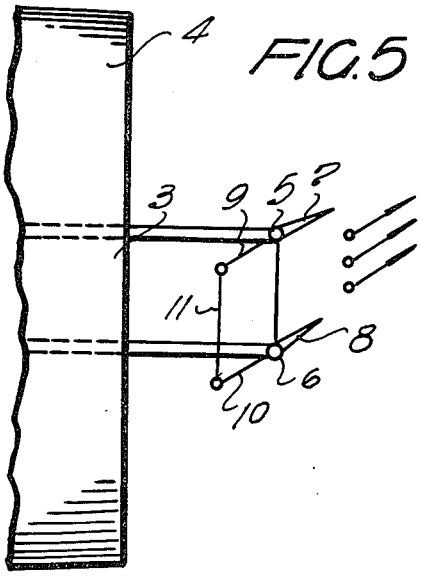
FIG. 5 shows schematically the biasable fins turned towards the right.
Figure 8:
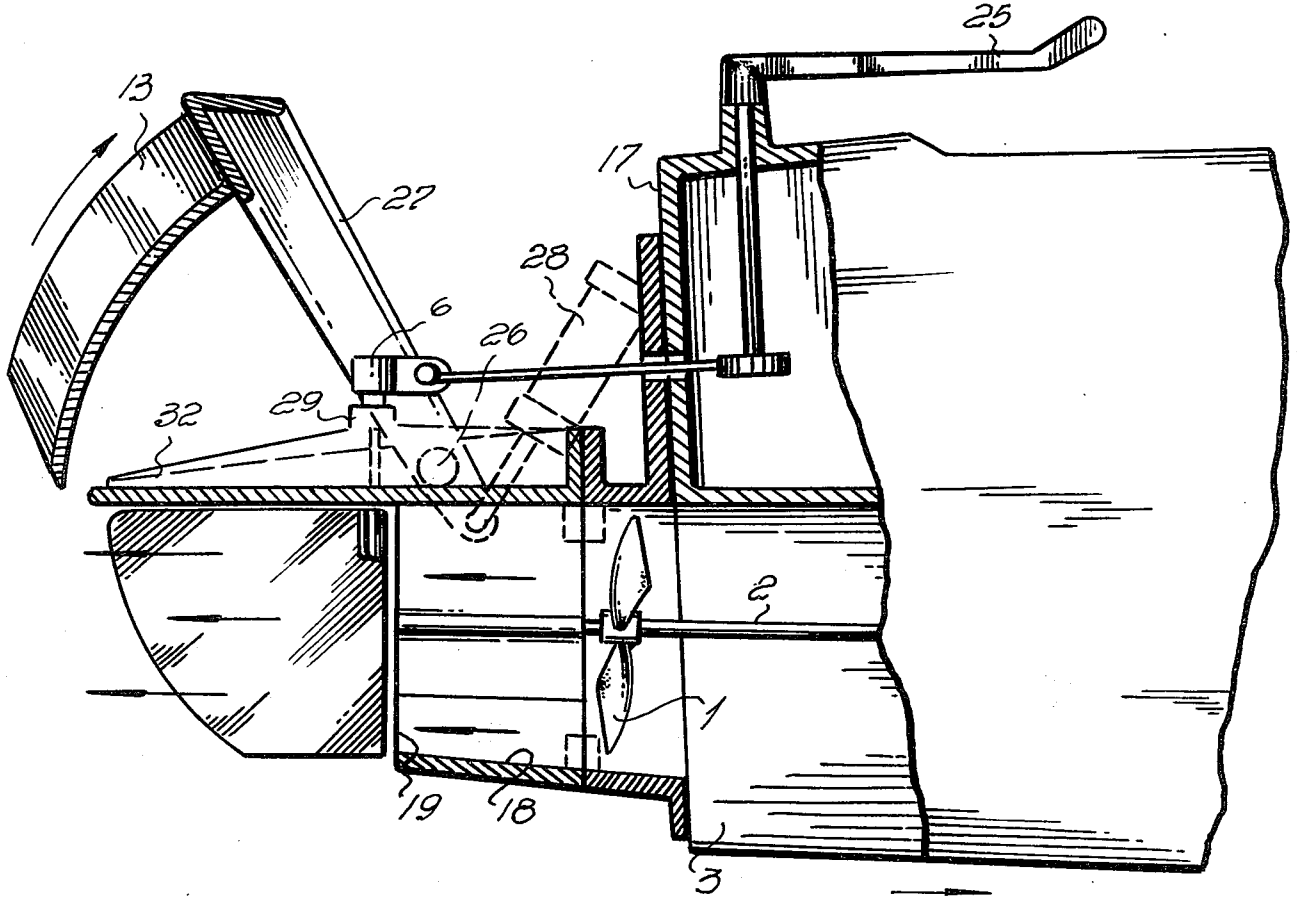
FIG. 8 shows in longitudinal section a boat equipped with the variant of the propelling device according to the invention.
Figure 12:
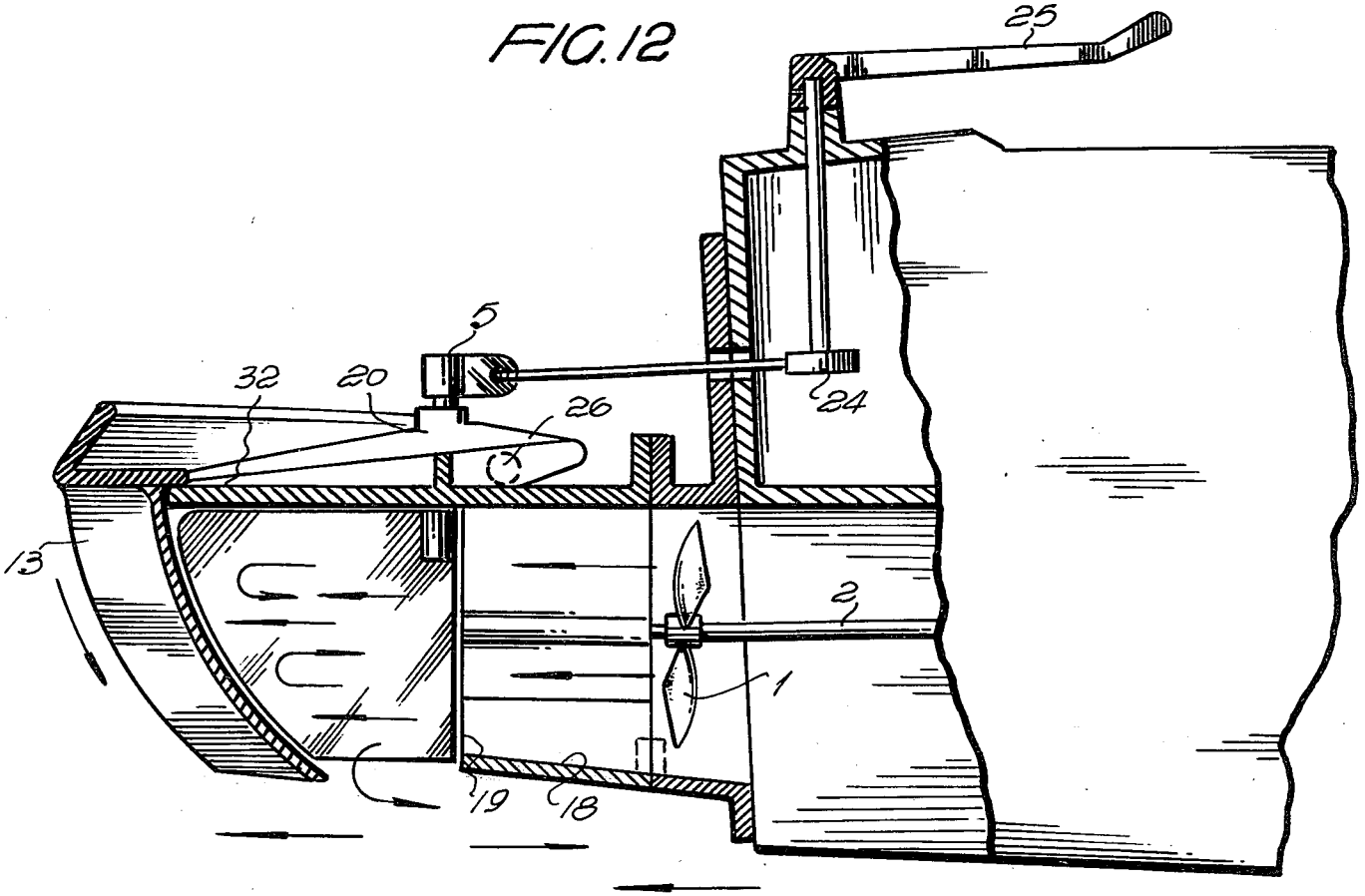
FIG. 12 is a view similar to that of FIG. 8, but showing the reverse motion plate in operative position.

A curved plate 13, mounted rotatively on a horizontal shaft 12 can be interposed in the exit section of the mass of water to deflect the same forwards and downwards, thus causing by reaction the braking or reverse motion of the boat 4 (FIG. 6).

Figure 7:
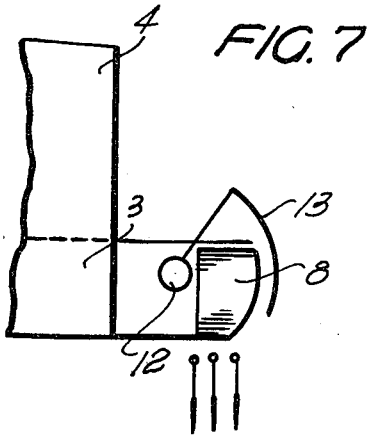
FIG. 7 shows schematically the curved plate in an intermediary position.

FIG. 7 shows the plate 13 in an intermediate position in which the mass of water is deflected vertically; in this position the reaction will tend to lift the stern of the boat, which is extremely useful in order to reduce the effort necessary to clear the boat when it has run aground.

FIG. 1 shows engine 14 which is connected to the propeller shaft 2 by means of pulleys 15 and belts 16 thus eliminating the speed box and the transmission case and simplifying the mechanical structure of the assembly.

Figure 2:
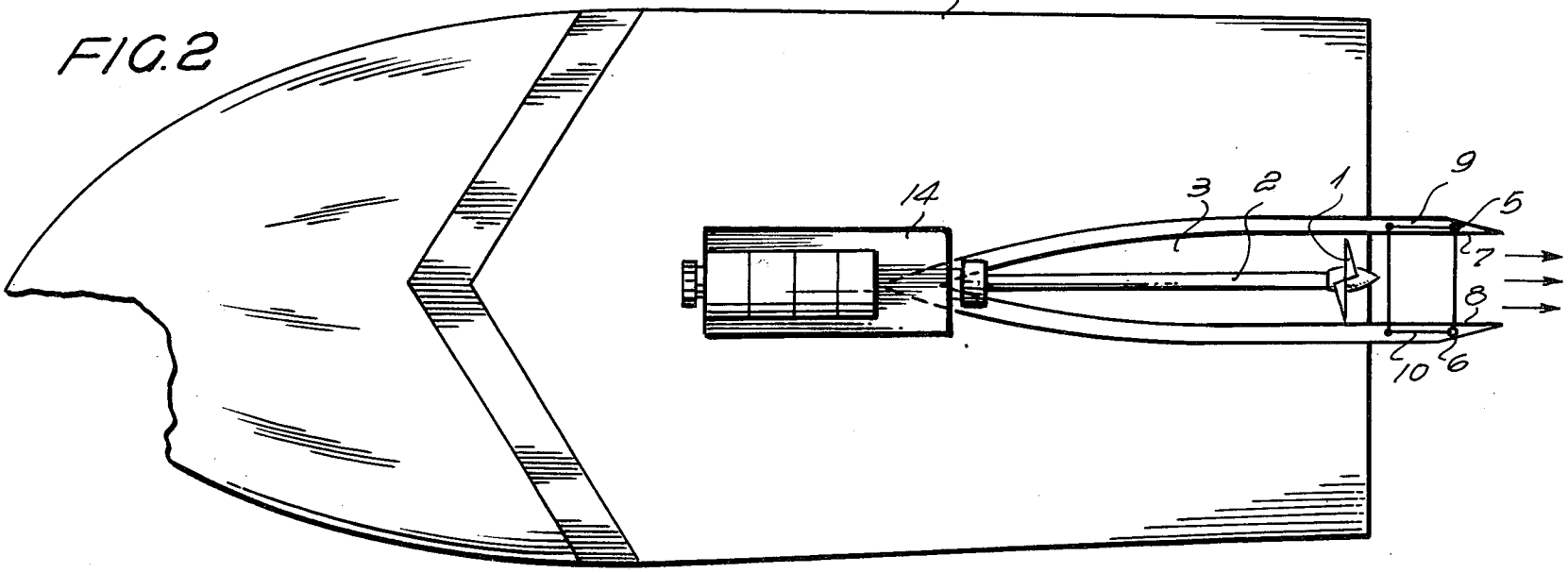
FIG. 2 is a plan view of a boat embodying the said propelling system, using direct control.
Figure 3:
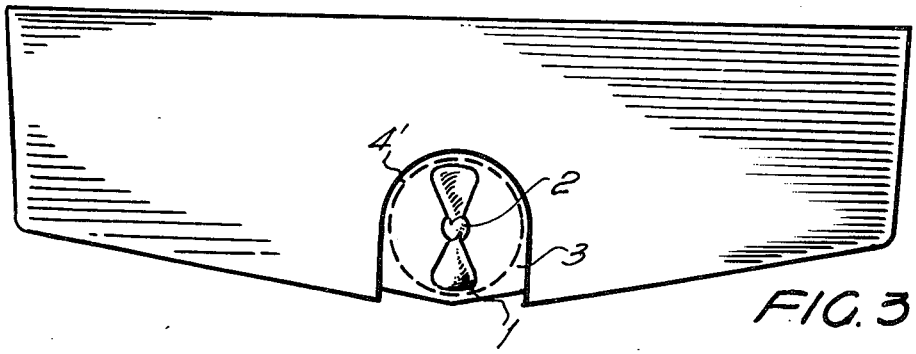
FIG. 3 is a front elevation view of the stern transom of a boat embodying the propelling system of this invention.

FIG. 2 shows the engine 14 connected directly to the propeller shaft 2, eliminating the speed box.

Referring now to the variant illustrated in FIGS. 8 to 13, the tunnel 3 extends from the stern transom 17 rearwardly by means of a tubular casing 18 the rear upper part of which extends beyond an end section 19 and forms there a prolongation 32 for mounting the parallel fins 7 and 8 at each side of the propeller shaft 2, the propeller being arranged inside the said casing.

The shafts 5 and 6 of the parallel fins 7 and 8 are mounted in bearings 20 and 21 situated adjacent to the end section 19; the biasing rotation of the said fins is controlled by arms 22 and 23 connected to a rubber control handle 25 through mechanism 24.

The curved plate 13 is hinged by arms 27 to a shaft 26 journalled on the upper part of the tubular structure 18, and is moved to its several operative positions by means of a hydraulic cylinder 28.

Between the propeller and the end section 19 there are three partitions 29, 30 and 31 that intersect on a line coinciding with the propeller shaft and form between themselves dihedral angles of about 120°, improving the performance of the system.

What I claim is:

1. A propelling device for a propeller-driven boat having a hull with a stern transom and provided with a longitudinally-extending channel at the aft portion of the hull, said channel being open at the rear extremity thereof at said stern transom and along its entire length for flow of water therethrough, a propeller disposed in entirety in said channel adjacent said stern transom for rotation coaxially in said channel at a level above the keel of the boat, a pair of parallel vertical axles supported in spaced relation rearwardly of the stern transom, a pair of deflector fins carried by said axles for rotation about vertical axes passing through said axles, said fins being mounted rearwardly of the propeller, control rods connected to the fins, a connecting rod joining said control rods and being operative therewith to keep said fins parallel to one another while permitting conjoint parallel movement thereof under the action of a steering force applied to said connecting rod, and a curved deflector plate supported for pivotable movement about a horizontal axis disposed rearwardly of said stern transom between said vertical axles and said stern transom, said deflector plate being pivotable between a position in which the deflector plate is raised to an inoperative position in which it does not deflect the mass of water propelled rearwardly by the propeller and an operative position in which the mass of water propelled rearwardly by the propeller is caused to reverse direction.

2. A propelling device according to claim 1, wherein said fins are rotatable between a position in which the mass of water propelled rearwardly by the propeller is deflected to the left of the boat and a position in which the mass of water propelled rearwardly by the propeller is deflected to the right of the boat, thereby providing steering control for the boat.

3. A propelling device according to claim 1, comprising support structure projecting rearwardly beyond the rear transom of the boat, said fins and curved plate being mounted on said support structure rearwardly of said channel beyond the stern of the boat.

4. A propelling device according to claim 3, comprising partitions carried by the support structure, said partitions being angularly spaced from each other at an angle of substantially 120°.

5. A propelling device according to claim 1, comprising hydraulic means for effecting pivotal displacement of said curved deflector plate between said operative and inoperative positions.

* * * * *